US005145622A

United States Patent [19]

Shiffler

[11] Patent Number: 5,145,622

[45] Date of Patent: * Sep. 8, 1992

[54] IMPROVEMENTS IN PROCESS FOR PREPARING WATER-DISPERSIBLE POLYESTER FIBER

[75] Inventor: Donald A. Shiffler, Kinston, N.C.

[73] Assignee: E. I. Du Pont de Nemours and Company, Wilmington, Del.

[ * ] Notice: The portion of the term of this patent subsequent to Dec. 3, 2008 has been disclaimed.

[21] Appl. No.: 420,455

[22] Filed: Oct. 12, 1989

Related U.S. Application Data

[63] Continuation-in-part of Ser. No. 228,803, Jul. 28, 1988, abandoned, which is a continuation of Ser. No. 934,216, Nov. 21, 1986, abandoned.

[51] Int. Cl.[5] ..... D01F 6/62; D01F 11/04

[52] U.S. Cl. ..... 264/103; 264/129; 264/130; 264/134; 264/136; 264/145; 264/210.3; 264/210.8; 264/233; 264/235.6; 264/211.15; 264/346

[58] Field of Search ..... 264/211.14, 129, 103, 264/130, 134, 136, 145, 210.3, 210.8, 233, 235.6, 211.15, 346

[56] References Cited

U.S. PATENT DOCUMENTS

| | | | |
|---|---|---|---|
| 3,110,617 | 11/1963 | Scott | 427/175 |
| 4,316,924 | 2/1982 | Mineimura et al. | 428/89 |
| 4,396,389 | 8/1983 | Löfgrer | 8/115.5 |

FOREIGN PATENT DOCUMENTS

| | | |
|---|---|---|
| 3324662 | 7/1982 | Fed. Rep. of Germany . |
| 1189299 | 10/1959 | France . |
| 47-35608 | 9/1972 | Japan . |
| 49-1257 | 1/1974 | Japan . |
| 55-4845 | 2/1980 | Japan . |
| 56-31073 | 3/1981 | Japan . |
| 56-140167 | 11/1981 | Japan . |
| 58-169512 | 12/1983 | Japan . |
| 58-180672 | 1/1984 | Japan . |
| 61-231218 | 3/1987 | Japan . |
| 839456 | 6/1960 | United Kingdom . |
| 850169 | 9/1960 | United Kingdom . |
| 1093628 | 12/1967 | United Kingdom . |
| 1276329 | 6/1972 | United Kingdom . |

OTHER PUBLICATIONS

Hermann Ludewig, Polyester Fibres–Chemisty and Technology 1964, Engl Trans 1971, John Wiley & Sons Ltd., pp. 381–389.

*Primary Examiner*—Hubert C. Lorin

[57] ABSTRACT

Water-dispersible polyester fiber whose water-dispersibility is improved, and precursor filament tow are prepared by an improved process involving treatment of undrawn polyester filaments with a very small amount of caustic, when freshly-extruded, in a spin-finish.

10 Claims, No Drawings

IMPROVEMENTS IN PROCESS FOR PREPARING WATER-DISPERSIBLE POLYESTER FIBER

CROSS-REFERENCE TO RELATED APPLICATIONS

This application is a continuation-in-part of copending application Ser. No. 07/228,803, filed Jul. 28, 1988, now abandoned, which itself is a continuation of application Ser. No. 06/934,216, filed Nov. 21, 1986, now abandoned.

TECHNICAL FIELD

This invention concerns improvements in and relating to water-dispersible polyester fibers of various types and particularly their preparation.

BACKGROUND OF INVENTION

There has been increased interest in recent years in water-dispersible polyester fiber. Such water-dispersible fiber is used in various non-woven applications, including paper-making and wet-laid non-woven fabrics, sometimes as part of a blend, often with large amounts of wood pulp, e.g. for paper-making, and/or with other synthetic fibers, such as fiberglass, but also in applications requiring only polyester fiber, i.e. unblended with other fiber. This use, and the requirements therefor, are entirely different from previous more conventional use as tow or staple (cut fiber) for conversion into textile yarns for eventual use in woven or knitted fabrics, because of the need to disperse this fiber in water instead of to convert the conventional textile fiber into textile yarns, e.g. by processes such as carding, e.g. in the cotton system. It is this requirement for water-dispersibility that distinguishes the field of the invention from previous more conventional polyester staple fiber.

Most such water-dispersible polyester fiber is of poly(ethylene terephthalate), and is prepared in essentially the same general way as conventional textile polyester staple fiber, except that most water-dispersible polyester fiber is not crimped, whereas any polyester staple fiber for use in textile yarns is generally crimped while in the form of tow, before conversion into staple fiber. Thus, water-dispersible polyester fiber has generally been prepared by melt-spinning (i.e. extruding molten polyester) into a bundle of filaments, applying a spin-finish, combining the filaments to form a tow, drawing, applying a suitable coating to impart water-dispersing properties, preferably during the drawing operation, relaxing the drawn filaments at a temperature of 100° to 180° C., thereby preferably curing a preferred water-dispersing coating onto the filaments, and then, generally without any crimping (or with imparting only some mild wavy undulations in some cases so that the final sheet made therefrom has extra bulk and a three-dimensional matrix), converting the tow into cut fiber of appropriately short length. Some prior polyester staple fiber has been prepared in uncrimped form, e.g. for use as flock in pile fabrics, but for such use, water-dispersibility has not been required.

Polyester fibers are naturally hydrophobic, as reported, e.g. by Ludewig in Section 11.1.5 on pages 377–378 of "Polyester Fibres-Chemistry and Technology"—English Translation 1971—John Wiley and Sons, Ltd., which has posed a problem in regard to their suitability for wet-laying processes, as disclosed by Ring et al. in U.S Pat. No. 4,007,083, Hawkins in U.S. Pat. Nos. 4,137,181, 4,179,543 and 4,294,883, and Viscose Suisse in British Patent No. 958,430. These and other references suggest improvements in coatings to increase the ability of polyester fibers to disperse in water, and some new coatings have provided significant improvements, so far as regular polyester fiber is concerned. However, a need still exists for further improvement in water-dispersibility, especially for certain problem types. For instance, it is often desirable to use water-dispersible fiber of low denier, because lowering the denier generally provides better cover, better strength and softer products, but reducing the diameter increases the difficulty (and time) in obtaining a uniform dispersion which can avoid or minimize defects. It would also be desirable to use binder fibers in certain wet-laid products, but this has posed difficulties because we have found that preferred binder fibers have also been more difficult to disperse than regular polyester fibers, which are generally of poly(ethylene terephthalate), whereas preferred binder fibers are copolymers of lower melting point with comonomer residues such as isophthalates, e.g. of about 210° C. or less.

It is therefore an object of the invention to improve the water-dispersibility of polyester fiber, especially such types as may pose special problems. For most of the desired applications, I believe the water-dispersible polyester fiber should also show a low coefficient of friction, both towards other fibers, and towards metals, such as steel.

U.K. Patent No. 1,276,329 (Eastman Kodak) concerns a paper product reinforced with hydrophilic water-dispersible polyester fibers, the surfaces of which have been substantially hydrolyzed. The polyester fiber surfaces are treated with dilute alkali solution to achieve substantial saponification or hydrolysis to improve their dispersibility, so that they can be dispersed without the aid of wetting agents. The polyester tow is preferably drafted in a water bath containing sodium hydroxide (at 68° C. in Example 4) and steamed (at 150° C. in Example 4) to effect the surface treatment. This process has serious processing disadvantages and is believed not to solve the problem. It does not teach the use of any water-dispersing coating.

SUMMARY OF THE INVENTION

I have now found that the ability of such problem polyester fibers to disperse in water can be improved by adding a small amount of caustic soda to the spin-finish, i.e., much earlier in the fiber-making process, so that the caustic can modify the surface of these undrawn filaments as they are freshly extruded, so as to become hydrophilic. It is surprising that this can be achieved so simply, and so early in the process, and that this has not been recognized hitherto, despite other references in the literature to treatments of drawn polyester fibers with caustic soda.

Accordingly, there is provided an improvement in a process for preparing water-dispersible fiber, comprising the steps of melt-spinning polyester into filaments coating the freshly-extruded filaments with a spin-finish and collecting them in the form of a bundle, and further processing such bundle in the form of a tow, applying a water-dispersing coating, drawing and possibly annealing to increase orientation and crystallinity, and converting such drawn filaments into cut fiber, the improvement characterized by treating the freshly-extruded polyester filaments with a small amount of caustic, in sufficient amount and sufficiently rapidly so as to modify the surface of the polyester, so as to become hydrophilic, when washed. The resulting new and improved water-dispersible polyester fiber having a hydrophilic surface is also provided, according to other embodiments of the invention, as are the precursor tows and process for their preparation.

DETAILED DESCRIPTION OF THE INVENTION

For convenience, despite the fact that the characteristic polyester hydrophobic surface has been changed, I shall refer to both treated and untreated materials by the term "polyester".

The preparation of the water-dispersible polyester fiber may be carried out conventionally, as described hereinbefore, except for the application of caustic soda to the freshly-extruded filaments. Such polyester fiber is generally prepared first in the form of a continuous filamentary uncrimped tow or, if extra bulk is required, and a more three-dimensional matrix, the filaments may be provided with mild wave-like undulations by a mild crimping-type process, and the uncrimped or mildly wave-like filaments are cut to the desired cut length, i.e. to form the water-dispersible fiber, which is generally sold in the form of bales, or other packages of cut fiber. Suitable cut lengths are generally from about 5 to about 60 mm (¼ to 2½ inches), and of length/diameter (L/D) ratio from about 100:1 to about 2000:1, preferably about 150:1 to about 1500:1, it being an advantage of the invention that good performance may be obtained with an L/D ratio higher than has generally been considered satisfactory hitherto. A suitable denier per filament is generally from about 0.5 to about 20, it being a special advantage of the invention that lower denier fibers of about 0.5 to about 1.2 may be rendered water-dispersible more easily than by certain prior art methods that have been used or attempted commercially. The coating is generally present in amount about 0.04 to about 1.0% of the weight of fiber (OWF %).

According to the invention, this conventional process is modified by treating the freshly-extruded filaments with caustic. As indicated, this is most conveniently effected by adding an appropriate amount of caustic soda to the spin-finish that is applied to the freshly-extruded filaments, since the application of finish is essentially the first treatment or contact that the freshly-extruded filaments encounter after solidification.

The finish is generally applied by a finish roll, rotating in a bath of the finish, so that the filaments pass through the finish emulsion as they brush past the finish roll on their way from the solidification zone to the feed roll that determines the withdrawal speed from the spinneret. Before the finish roll, it is generally desirable to avoid or minimize contact between the filaments and solid objects, and so the only other closely-adjoining solid objects are generally guides that are intended to confine the filaments before contacting the finish roll. A finish roll is not the only method of applying finish, and other methods have been used and suggested, including spraying or metering the finish onto the filaments. It is important, according to the invention, that this treatment with caustic be effected on these freshly-extruded filaments, which are often referred to as "live" filaments, since the effect appears to be different from that obtained if caustic soda is applied at a later stage to the drawn fibers.

The effect of the invention is different from that of mercerizing, i.e. the effect of soaking fabrics or drawn yarns in hot strong NaOH, such as has been described by Ludewig in Section 11.2.3.1 on pages 387–389, and by others, whereby a significant amount of the fiber is removed as if it was peeled away. Such treatment wastes a significant amount of the polyester and leaves an entirely different surface, which is extremely rough when examined under high magnifications, and this roughness (under high magnification) produces lower fiber-to-fiber friction. In other words, the fibers can slip by each other more easily. This can be a desirable effect, but can produce processing difficulties. In other words, a mercerizing-type treatment provides a different result in regard to the surface roughness, and may be undesired.

Precautions need to be taken and modifications must probably be made to avoid or minimize corrosion or other contamination and other disadvantages that may result because of the use of caustic according to the invention. For such reasons, hitherto, it has been considered highly undesirable to include any dangerous or corrosive material, such as caustic soda, even in the small amounts indicated, at this stage of the process. This is at least one reason why, so far as I know, hitherto, there has previously been a prejudice against the use of a material such as caustic soda at this stage of a process for preparing polyester water-dispersible fiber. In this regard, it should be recognized that the filaments travel at relatively high speeds (of several hundreds of meters per minute) so that it is difficult to avoid ,slinging,, i.e., release of droplets of finish from these high speed filaments after application of the finish.

One way to measure the effectiveness of the treatment according to the invention may prove to be by measuring the Carboxyl Equivalent (CE) of the surface on the weight of the drawn fiber, since the improved water-dispersibility may correlate with at least a threshold value of such surface carboxyl equivalents, i.e. carboxyl groups ,on the surface of the filament or fiber. This is because it appears that there has been a chemical change to the surface of the filament or fiber, from its regular hydrophobic nature, that has been a characteristic of polyester as reported, e.g. by Ludewig. The core appears to be relatively unchanged from regular polyester polymer, whereas the surface has been significantly changed so that the fiber surface shows a hydrophilic nature. Since the treatment is applied to the surface of the freshly-extruded filament, which is undrawn, and this filament is then subjected to a drawing process, in which the surface of the filament is significantly increased, which must mean that new surface is created from polymer that had previously been concealed beneath the surface of the undrawn filament, it is extremely surprising that any difference is shown in the water-dispersible fiber, which has been drawn. Indeed, we have found that CE values can be higher for drawn filaments than for undrawn filaments.

At this point, I refer to copending application Ser. No. 420,457 (DP-4265-B), now U.S. Pat. No. 5,069,847, filed simultaneously herewith, because it describes the surface-modification of polyester filaments by the application of caustic soda in the spin-finish during the preparation of filamentary tows, staple fiber and spun yarn therefrom, and because several comments, and in particular tests, comparisons and thresholds as indicated by the polyester having at least 0.2 carboxyl equivalents per million grams, preferably at least 0.3 carboxyl equivalents per million grams, of drawn fiber, related therein could apply also to the polyester fibers treated according to the present invention, and so the disclosure therein is hereby incorporated by reference, as is the disclosure in copending application Ser. No. 420,458 (DP-4266-B), now U.S. Pat. No. 5,069,845, filed simultaneously herewith, because it describes surface-modification of polyester filaments by application of caustic potash. As disclosed in the copending applications, the effects of caustic in the spin-finish are remarkably durable in those applications. I do not yet know whether similar advantages will be found in wet-laid fabrics prepared from water-dispersible fibers according to this invention, but if such advantages are obtainable, the resulting wet-laid products would also be new, surprising and useful, according to this invention, including paper.

The invention is further described in the following Examples:

EXAMPLE 1

The following fibers (Fibers E, L, M, N and P) were all spun from poly(ethylene terephthalate) of intrinsic viscosity 0.64, containing 0.3% $TiO_2$ as a delusterant.

Fiber E was spun using a 900-hole spinneret with round holes 0.015 inches in diameter and a capillary length of 0.030 inches. The spinneret was surrounded by a 270° C. block, polymer throughput was 47.6 pounds/hour, and the filaments were collected on bobbins at 1600 yards per minute. Denier per filament was approximately 2.5. Conventional air quenching from a radial diffuser was used. After quenching was essentially complete, but before the end was wound on the bobbin, regular commercial spin-finish (3.5% bwt in water) was applied as a spin finish.

Fiber E was then oriented by running from a set of feed rolls at 25.9 yards/minute to first draw rolls running at 69.6 yards per minute. Between roll sets, it was washed with water at 45° C. to remove spin-finish and condition the fibers. It was next run to the second draw rolls running at 80.2 yards/minute. Between first draw and second draw rolls, the fiber was washed with water at 98° C. Fiber E was then annealed on a set of 6 rolls running 80.1 yards/minute having a temperature of 190° C. A water-dispersing finish was sprayed on the fiber, and it was delivered to a conveyer at 78.2 yards/minute by a set of puller rolls. It was then dried at 70° C. for 6 minutes.

Fibers L, M and N were spun using essentially the same conditions, except that 1.0% by weight of NaOH was added to the spin-finish, the spinning speed was 1200 yards/minute, and positional throughput and spun denier were as follows:

| FIBER | POSITION THROUGHPUT, LB/END HR. | SPUN DPF |
|---|---|---|
| Fiber L | 68.2 | 4.7 |
| Fiber M | 56.4 | 3.9 |
| Fiber N | 40.3 | 2.9 |

Fiber P was spun with the same conditions as those above except that the scalloped-oval spinneret used was that in Example 1 of U.S. Pat. No. 4,707,407, issued Nov. 17, 1987, to Clark and Shiffler, position throughput was 55.0 pounds per hour, and the spun dpf was 3.2.

Fibers L, M, N and P were then oriented using a process involving superdrawing. In this process, the fibers were first passed over a set of superdraw rolls running at the speeds indicated below, the fibers were washed and heat treated in a water bath at 98° C., and run to a set of feed rolls at the speeds indicated below. During contact with the feed roll set, the fibers were washed with water at 45° C. and fed to a set of draw rolls running at the speeds indicated below. Between final feed and draw rolls, the yarn is again washed with .98° C. water. After leaving the draw rolls, a water-dispersing finish was applied, the fiber was delivered to a conveyer by a set of puller rolls running at approximately the draw roll speed, and relaxed at 150° C. for 6 minutes.

| FIBER | SUPERDRAW ROLL SPEED, YPM | FEED ROLL SPEED, YPM | DRAW ROLL SPEED, YPM |
|---|---|---|---|
| Fiber L | 17.1 | 27.7 | 79.7 |
| Fiber M | 13.9 | 27.7 | 79.7 |
| Fiber N | 12.1 | 27.7 | 79.7 |
| Fiber P | 16.6 | 29.8 | 80.2 |

Properties of these fibers are summarized below:

| PROPERTY | FIBER E | FIBER L | FIBER M | FIBER N | FIBER P |
|---|---|---|---|---|---|
| Denier/Filament | 0.88 | 1.17 | 0.79 | 0.50 | 0.77 |
| Finish on Yarn, % | 0.60 | 0.48 | 0.55 | 0.62 | 0.79 |
| Boil Off Shrinkage, % | 5.0 | 0.4 | 0.2 | 0.1 | 1.0 |
| 196° C. Dry Heat Shrinkage, % | 13.8 | 3.0 | 3.4 | 3.6 | 2.9 |
| Tenacity, GPD | 7.1 | 3.9 | 3.7 | 4.2 | 2.7 |
| Elongation, % | 12 | 59 | 67 | 52 | 61 |
| Tenacity at 2% Elongation, GPD | 1.47 | .80 | .85 | 1.20 | .81 |

These fibers were cut into samples of ¼-inch and ⅜-inch length and were treated in an experimental inclined wire Fourdrinier machine. Fibers were dispersed for six minutes in a small pulper as described in Example 1. Fibers were then mixed with unrefined sulphite pulp to form an 80% polyester blend and processed into fabrics with a finished fabric weight averaging 40 grams/square meter, as described in Example 1.

Inclined wire Fourdrinier performance for the above fibers was rated during the run with the results summarized below:

| FIBER | CUT LENGTH, INCH | FIBER PERFORMANCE |
|---|---|---|
| FIBER E | .250 | POOR QUALITY, MANY LOGS, FUSED FIBERS, DRIER BREAKS BECAUSE OF HIGH SHRINKAGE |

-continued

| FIBER | CUT LENGTH, INCH | FIBER PERFORMANCE |
|---|---|---|
| FIBER E | .375 | POOR QUALITY, LOGS, DRIER BREAKS |
| FIBER L | .250 | GOOD DISPERSION, SOME VERY SMALL LOGS |
| FIBER L | .375 | GOOD DISPERSION, SOME VERY SMALL LOGS |
| ITEM M | .250 | GOOD DISPERSION, SOME SMALL LOGS |
| ITEM M | .375 | GOOD DISPERSION, SOME SMALL LOGS |
| ITEM N | .250 | NO HARD LOGS, GOOD DISPERSION, SOME ROPES |
| ITEM N | .375 | NO HARD LOGS, GOOD DISPERSION, MORE ROPES |
| ITEM P | .250 | GOOD DISPERSION |
| ITEM P | .375 | GOOD DISPERSION |

Fabric from this series with 0.25 inch cut length was evaluated for uniformity, and the presence of log defects as follows. Fiber E was not rated because quality was so obviously poor.

| FIBER | UNIFORMITY | LOG AND STICK DEFECTS |
|---|---|---|
| Fiber L | 1 | 1 |
| Fiber M | 3 | 2 |
| Fiber N | 4 | 3 |
| Fiber P | 2 | 1 |

Although all fabrics were satisfactory, the scalloped-oval version (P) gave better uniformity and log performance at equivalent dpf.

The water-dispersing coating used in the Example was the same as used in the Examples of U.S. Pat. No. 4,707,407 (Clark and Shiffler), but any of the other water-dispersing coatings mentioned therein may be used, as indicated therein, so our copending application is hereby incorporated by reference herein. As pointed out, the coating, especially a synthetic copolyester of poly(ethylene terephthalate) units and poly(oxyalkylene) groups as described, is preferably cured on the filaments by heating the coated filaments, or the resulting staple fiber, if desired, to a temperature of about 100° to about 190°, and this normally occurs during relaxing after drawing.

EXAMPLE 2

The following fibers, Fiber A made with conventional spin finish, and Fiber Q made with spin finish to which NaOH was added, were spun from polyethylene terephthalate of intrinsic viscosity 0.64, containing as a comonomer about 11.4% diethylene glycol by weight, and 0.3% $TiO_2$ as a delustrant.

Fiber A was spun at 1600 yards/minute using a 1030-hole spinneret with round holes 0.015 inches in diameter and a capillary length of 0.060 inches. The spinneret was surrounded by a 277° C. block and polymer throughput was 61 2 pounds/hour. Sixteen (16) ends (a total of 16480 filaments) were combined and fed into a large can or tub at 1600 yards/minute Denier per filament was approximately 2.7. Conventional air quenching from a radial diffuser was used. After air quenching was essentially complete, but before the tow was pulled to the tub, a 1.25% solution of regular commercial spin-finish in water was applied with a roll to approximately 2% total (finish+water) on the tow.

Fiber A was then oriented by combining a total of 32 ends (32960 filaments) to form a tow and running from a set of feed rolls 30.8 yards/minute to draw and puller rolls at 80.4 yards/minute. Between feed and draw rolls, spin finish was washed from the fiber by water at 45° C. Between draw and puller rolls, a water spray at 90° C. provided additional washing. Between draw and puller rolls a commercial water-dispersing finish was applied to the fiber. The tow was then relaxed free in an oven at 120° C. for 6 minutes.

The resulting Fiber A had the following properties:
1.58 denier/filament
0.68% water-dispersing finish (solids) on fiber
1.9% boil-off shrinkage
15.2% dry heat shrinkage at 150° C.
Tenacity at break of 2.6 grams/denier
Elongation at break of 64%
Tenacity at 2% elongation of 0.58 grams/denier Fiber Q was produced in a similar manner to Item A with the following exceptions:
Only one end was produced by winding on a tube at 1600 yards/minute rather than blowing into a tub at the same speed
After air-quenching was essentially complete, but before it was wound on the tube, the same 3.5% finish solution in water was applied to the fiber using a finish roll, except that 1% NaOH was added.
Thirty-nine individual ends were combined for the orientation
The draw roll speed was 79.5 yards/minute
The bath between feed and draw rolls was at 98° C.
The resulting Fiber Q had the following properties:
1.50 denier/filament
0.54% by weight water-dispersing finish on tow
3.1% boil-off shrinkage
14.9% dry heat shrinkage at 150° C.
Tenacity at break 2.9 grams/denier
Elongation at break 66%
Tenacity at 2% elongation 0.62 grams/denier Both fibers were cut into samples of ½-inch length and were tested in an experimental inclined wire Fourdrinier machine. Fibers were dispersed for two minutes in a small pulper at 0.99% consistency (lbs. fiber per 100 lbs. slurry, or furnish). The cylindrical pulper was approximately 2 feet in diameter by 6 feet deep. Fibers were then mixed with unrefined sulphite pulp to form 50% and 80% polyester blends, which were diluted to 0.1% consistency in aa 10-cubic meter stock tank, or chest This stock was further diluted in the headbox of the machine to 0.016% consistency and formed into a 0.5 meter wide, wet-lay nonwoven fabric at 20 meters/-minute. A spray of an acrylic binder (Primal E-32), was applied at the end of the Fourdrinier wire. The fabric was then cured in a through air drier at 125° C. Finished fabric weight averaged 40 grams/square meter. In industrial practice, this fiber is intended for thermal bonding in which heat to ca. 170° C. or above and pressure take the place of the chemical binder. The purpose of this test was to demonstrate good dispersion quality, which is a prerequisite to thermal bonding, so acrylic chemical binder was used to insure good fabric integrity during testing.

Logs are hard agglomerates of undispersed fibers representing a severe quality defect which are especially common in binder fibers because of their low melting point. Log performance of the fibers was assessed at the Fourdrinier machine with the following results:

| SAMPLE | CUT LENGTH INCHES | BLEND LEVEL % POLYESTER | LOG ASSESSMENT |
|---|---|---|---|
| FIBER A | 0.5 | 50 | UNSATISFACTORY NUMBER OF LOGS |
| FIBER Q | 0.5 | 50 | NO OBSERVABLE LOGS |
| FIBER A | 0.5 | 80 | UNSATISFACTORY NUMBER OF LOGS |
| FIBER Q | 0.5 | 80 | NO OBSERVABLE LOGS |

The fabrics were then rated visually for fabric uniformity, by an uninvolved third party, and ranked in order of decreasing uniformity. Results were:

| FIBER | CUT LENGTH INCHES | BLEND LEVEL % POLYESTER | RATING | COMMENTS |
|---|---|---|---|---|
| FIBER Q | 0.5 | 50 | 1 | — |
| FIBER Q | 0.5 | 80 | 2 | — |
| FIBER A | 0.5 | 50 | 3 | UNSATISFACTORY |
| FIBER A | 0.5 | 80 | 4 | UNSATISFACTORY |

Physical properties of the 80% fabrics were obtained from outside independent evaluators. Compared to Fiber A at 100% Fiber Q had the following properties:

Bulk, TAPPI T410 om-83 and T411 om-83: 101%
Burst Index, TAPPI T403 os-76: 128%
Tensile Index, TAPPI T494 OM-81: 122%
Tensile Stretch, TAPPI T494 om-81: 80%
Tear Index, TAPPI T414 om-82: 123%
Smoothness, according to DIN 53107: 111%
Permeability, close to DIN 53120 on apparatus Frank: 83%
Opacity, according to ISO 2471: 103%

All results, higher bulk, burst, tensile, tear, smoothness, and opacity and lower permeability are consistent with improved fiber dispersion.

The advantage of using low melting copolyester binder fibers (Fiber Q) may be seen from the values shown in Table 1, which shows various properties of papers from parts by weight of softwood Kraft reinforced with 5 parts by weight of polyester of denier 1.5 and cut length ¼-inch. As background, polyester fibers are generally added to wood pulp papers as reinforcement (to increase tear strength), but we have found that other properties (such as tenacity, elongation, work-to-break and Mullen burst strength) are reduced, and linting has also been found a problem in printing. By bonding, using the indicated low melting copolyester binder Fiber Q, however, the linting and printing performance should be improved and, more importantly, a significant increase in all strength properties has been obtained, including tear strength. The comparison shows, as item 1, regular commercial homopolymer (H), and the copolyester (Q) as items 2–4, items 3 and 4 being bonded for 2 minutes in a platen press without pressure, whereas items 1 and 2 are not bonded. Item 3 (Q bonded at 350° F. shows a significant increase in all indicated strength properties over item 1 (the regular homopolymer). Even a slight increase in bonding temperature to 375° F., however, causes a significant loss in these properties, so that item 3 is comparable in strength to unbonded item 1. It would be pointless to try bonding the homopolymer, in view of its h higher melting point, and it is desirable to keep the bonding temperature low enough to avoid harming the cellulose component of the blend. This is why it is desirable to use a binder fiber of adequately low melting point but, until the invention, there has been a problem in dispersing such fibers in water using conventional methods and coatings. Item 2 shows that most strength properties are not improved by changing from the homopolymer to the copolyester fiber unless bonding is effected.

TABLE 1

| Item No. | Fiber Polyester | Bonding Temp. °F. | BW Oz/Yd.$^2$ | Thickness Mils | Elm. Tear g/B.W. | Mullen Burst PSI/B.W. | Ten. Lbs./In./B.W. | Elong. % | Work to Break PSI/B.W. |
|---|---|---|---|---|---|---|---|---|---|
| 1 | H | No | 3.7 | 7.8 | 43 | 6.1 | 3.4 | 1.2 | .030 |
| 2 | Q | No | 3.5 | 9.0 | 37 | 4.1 | 2.0 | 1.1 | .018 |
| 3 | Q | 350 | 3.5 | 8.7 | 49 | 8.0 | 4.3 | 1.5 | .051 |
| 4 | Q | 375 | 3.5 | 9.1 | 45 | 4.5 | 3.5 | 1.1 | .033 |

The ease of dispersion of Fiber Q is indicated by carrying out the method published in TAPPI Journal, Vol. 68, No. 8 (August, 1985), pages 88–91, using 1100 rpm agitator speed, and the results are given in Table 2. The comparison Fiber P is essentially similar to Fiber A, but contains a lower amount (only 6.8% BWT) of diethylene glycol, and should therefore be easier to disperse than Fiber A, as indicated herein, being of higher melting point and softening point. The lower the mixing time, under comparable conditions, the easier any fiber is to disperse. In practice, any fiber providing a log level by this method, and at this speed of 1100 rpm, of less than 500/100 g will provide sheet uniformity that is satisfactory according to the standards of 1986, although lower log levels, such as 200 or less will be preferred. The advantage of the binder Fiber Q is very significant.

TABLE 2

| Mixing Time Minutes | Logs/100 g Fiber P | Fiber Q |
|---|---|---|
| 1 | 4920 | 190 |
| 4 | 2250 | 80 |
| 10 | 990 | 30 |
| 20 | 380 | 0 |

Any suitable polymer may be used for the binder fiber, e.g. polymer disclosed in Scott, U.S. Pat. No. 4,129,675, Pamm, U.S. Pat. No. 4,281,042, Frankosky, U.S. Pat. U.S. Pat. No. 4,304,817 or Marcus U.S. Pat. Nos. 4,794,038 and 4,818,599, provided the appropriate fiber dimensions and water-dispersible coating were used.

To develop the desired hydrophilic properties on the surfaces of the modified water-dispersible fiber of the invention, it is believed necessary to wash the fibers, as disclosed in the copending applications, but this occurs according to the invention almost inevitably during normal processing of the water-dispersible fiber. In addition to caustic soda and caustic potash, other alkali metal and alkaline earth metal hydroxides, especially $Ca(OH)_2$, are expected to give good results in a spin finish, as mentioned in these copending applications.

I claim:

1. An improvement in a process for preparing water-dispersible fiber, comprising the steps of melt-spinning polyester into filaments that are quenched as they are withdrawn from the spinneret at a speed termed the withdrawal speed, coating the freshly-extruded filaments with a spin-finish and collecting them in the form of a bundle, and further processing such bundle in the form of a tow, applying a water-dispersing coating, drawing and possible annealing to increase orientation and crystallinity, and converting such drawn filaments into cut fiber, wherein the improvement consists in treating the freshly-extruded polyester filaments with a spin-finish containing an amount of caustic selected and at a location selected such that, in combination with the withdrawal speed and quenching conditions, the caustic treatment is sufficiently soon so as to modify the surface of the polyester, so as to become hydrophilic, when washed, as indicated by the polyester having at least 0.2 surface carboxyl equivalents per million grams of drawn fiber.

2. A process according to claim 1, wherein the freshly-extruded polyester filaments are treated so that the polyester has at least 0.3 surface carboxyl equivalents per million grams of drawn fiber.

3. A process according to claim 1 or 2, wherein the water-dispersible fiber is of denier 1.2 or less.

4. A process according to claim 1 or 2, wherein the water-dispersible fiber is a binder fiber consisting essentially of a copolymer of ethylene terephthalate of melting point about 210° C. or less.

5. A process according to claim 3, wherein the water-dispersible fiber is a binder fiber consisting essentially of a copolymer of ethylene terephthalate of melting point about 210° C. or less.

6. An improvement in a process for preparing a filamentary tow, comprising the steps of melt-spinning polyester into filaments that are quenched as they are withdrawn from the spinneret at a speed termed the withdrawal speed, collecting he freshly-extruded filaments in the form of a bundle and coating them with a spin-finish, further processing such bundle in the form of a tow, and applying a water-dispersing coating, and drawing and possibly annealing to increase orientation and crystallinity, wherein the improvement consists in treating the freshly-extruded polyester filaments with a spin-finish containing an amount of caustic selected and at a location selected such that, in combination with the withdrawal speed and quenching conditions, the caustic treatment is sufficiently soon so as to modify the surface of the polyester, so as to become hydrophilic, when washed, as indicated by the polyester having at least 0.2 surface carboxyl equivalents per million grams of drawn fiber.

7. A process according to claim 6, wherein the freshly-extruded polyester filaments are treated so that the polyester has at least 0.3 surface carboxyl equivalents per million grams of drawn fiber.

8. A process according to claim 6 or 7, wherein the filaments are of denier 1.2 or less.

9. A process according to claim 6 or 7, wherein the filaments are of binder material consisting essentially of a copolymer of ethylene terephthalate of melting point about 210° C. or less.

10. A process according to claim 8, wherein the filaments are of binder material consisting essentially of a copolymer of ethylene terephthalate of melting point about 210° C. or less.

* * * * *

UNITED STATES PATENT AND TRADEMARK OFFICE

CERTIFICATE OF CORRECTION

PATENT NO. : 5,145,622

DATED : September 8, 1992

INVENTOR(S) : Donald Albert Shiffler, et al

It is certified that error appears in the above-identified patent and that said Letters Patent is hereby corrected as shown below:

On the title page, item [75] add inventor:

--Teddy H. Grindstaff--

Signed and Sealed this

Nineteenth Day of January, 1993

*Attest:*

DOUGLAS B. COMER

*Attesting Officer*

*Acting Commissioner of Patents and Trademarks*